US010234245B2

(12) United States Patent
Mickiewicz

(10) Patent No.: US 10,234,245 B2
(45) Date of Patent: Mar. 19, 2019

(54) MULTIPLE PLATE BALLISTIC SHIELD WITH BALLISTIC LAYERING

(71) Applicant: Dean Chester Mickiewicz, Ocala, FL (US)

(72) Inventor: Dean Chester Mickiewicz, Ocala, FL (US)

( * ) Notice: Subject to any disclaimer, the term of this patent is extended or adjusted under 35 U.S.C. 154(b) by 0 days.

(21) Appl. No.: 15/244,168

(22) Filed: Aug. 23, 2016

(65) Prior Publication Data

US 2018/0058819 A1 Mar. 1, 2018

(51) Int. Cl.

| | |
|---|---|
| ***F41A 25/00*** | (2006.01) |
| ***F41H 5/08*** | (2006.01) |
| ***F41H 5/18*** | (2006.01) |
| ***F41H 5/013*** | (2006.01) |

(52) U.S. Cl.
CPC ..... *F41H 5/08* (2013.01); *F41H 5/013* (2013.01); *F41H 5/18* (2013.01)

(58) Field of Classification Search
CPC ..... F41H 5/08
USPC ..... 89/37.07
See application file for complete search history.

(56) References Cited

U.S. PATENT DOCUMENTS 9,200,875 B1 * 12/2015 Saucedo ..... F41H 5/26
9,347,747 B2 * 5/2016 Mickiewicz ..... F41H 5/26

* cited by examiner

*Primary Examiner* — J. Woodrow Eldred

(57) ABSTRACT

A ballistic shield may include multiple ballistic plates. The first plate may be smaller contain a handle and viewport and be able to connect to a second plate. The second plate shall be able to connect to the first plate and when combined, can create a larger shield using only the handle and viewport of the first plate. Other plates may be connected to the second plate to increase the ballistic coverage required. A rotating plate can be connected with a hinge and spacer. When dropped the rotating plate would enable extended coverage. When the rotating plate is rotated upward, an additional layer of ballistic coverage is provided.

3 Claims, 7 Drawing Sheets

MULTIPLE PLATE BALLISTIC SHIELD WITH BALLISTIC LAYERING

RELATED APPLICATIONS

Provisional application No. 62/283,337, filed on Aug. 28, 2015 and now abandoned.

BACKGROUND OF THE INVENTION

1. Field of the Invention

The present invention is for man portable (hand held ballistic shields), but may be used for non man portable shields.

2. Description of Related Art

Ballistic shields are used anywhere that a ballistic threat is possible. The main users are security, law enforcement and military. Typically ballistic shields are not meant to replace personal body armor (such as vests), but to add additional protection over areas not protected by a vest and to provide additional protection over areas already protected by the user's body armor.

Ballistic shields (ballistic plates designed to stop or significantly reduce the trauma from high velocity projectiles—such as bullets) are typically one piece. Shields for coverage over the head and chest areas are usually larger and heavy enough such that they are not carried for routine use and thus not available when the threat occurs.

Extended body (Head and chest front, pubic region front, upper leg) coverage with existing ballistic shields usually are large once piece shields. Shields of this type must be stored in larger containment areas, such as the trunk of a police car. Smaller ballistic shields (for head and neck protection) do not exist that can also have other ballistic plates (such as an extension panel to increase ballistic coverage) attached later for extended body (if needed) coverage.

In many emergency situations the type of firearm is not immediately known. Many ballistic shields may be deployed which may only stop handguns. The user may need to fold the shield to provide greater the ballistic protection (and reduce the ballistic coverage) to stop many higher velocity projectiles as from assault pistols and rifle fire.

Therefore, a ballistic shield system is needed that can be rapidly deployed in confined space and can be connected together with other shields for the ballistic coverage required. When connected to an extension shield, enable the entire shield assembly to need only the handle and viewport of the initial shield. Extension shields could be rigid or able to fold such that more than one layer of ballistic protection exists for the user while still providing an unobstructed view through the viewport.

SUMMARY OF THE INVENTION

In accordance with this invention, there is one primary ballistic plate which contains ballistic material. This ballistic plate has a handle and features for connecting to other ballistic plates. The ballistic plate may possibly have more features, such as a viewport. There is also a secondary ballistic plate which contains ballistic material and can connect to the primary ballistic plate. These first two ballistic plates comprise the core of the embodiment.

The secondary ballistic plate is wider and longer than the primary ballistic plate, but not necessarily a greater surface area. When connected to the primary ballistic plate a larger ballistic shield exists. The secondary ballistic plate may be attached to other ballistic plates of different sizes to provide various ballistic coverage. An overlap between the first and second plates ensures that a gap does not exist for a projectile to pass through.

Further in accordance with this invention, the primary ballistic plate must be centered when attached to the secondary ballistic plate. Then the user of the ballistic shield will be able to hold the handle without having downward rotation.

A further implementation with this invention, the secondary ballistic plate or a plate attached to the secondary ballistic plate may have a spacer rigidly attached to it. A hinge maybe connected to the distal end of the spacer (away from the ballistic plate). The other leaf of this hinge could be attached to an additional ballistic plate, (called the rotating ballistic plate).

Another implementation coherent with the principles of this invention, is that the rotating ballistic plate can be in the "down" position for maximum ballistic coverage. Or the rotating ballistic plate may be in the "up" position. When the rotating ballistic plate is in the "down" position, overlap exists between the rotating plate and the ballistic plate that the spacer is attached to. When the rotating plate is in the "up" position, the secondary ballistic plate(s) are covered and two ballistic plates provide protection against projectiles. A cut out of ballistic material in the rotating ballistic plate ensures that the viewport in the primary ballistic plate is not covered.

BRIEF DESCRIPTION OF THE DRAWINGS

Similar reference numbers and designations in the various drawings indicate similar elements.

DETAILED DESCRIPTION

The invention described with reference to accompanying drawings, has at least one illustrative representation shown. This invention may be illustrated in different morphologies and should not be construed as limited to the representations contained in this document. The illustrations herewith are not limiting as to the scope of the invention.

Terms may be used interchangeably, unless made expressively clear from the text. The terms "ballistic panel", "plate" or "ballistic plate" shall be used interchangeably unless specifically made distinguishable from the text. The term "ballistic shield" shall mean a ballistic plate with at least one additional item attached to it. Similarly, the terms "hinge" and "components to enable rotation" shall be interchangeable. Some terms such as "connector" or "fastener" shall be deemed understandable by someone with proficient skills in this art. Some drawings views may have some items missing from an actual ballistic shield. Not having all items in every drawing view is done for clarity and understanding of the entities on that drawing.

Figure 1:
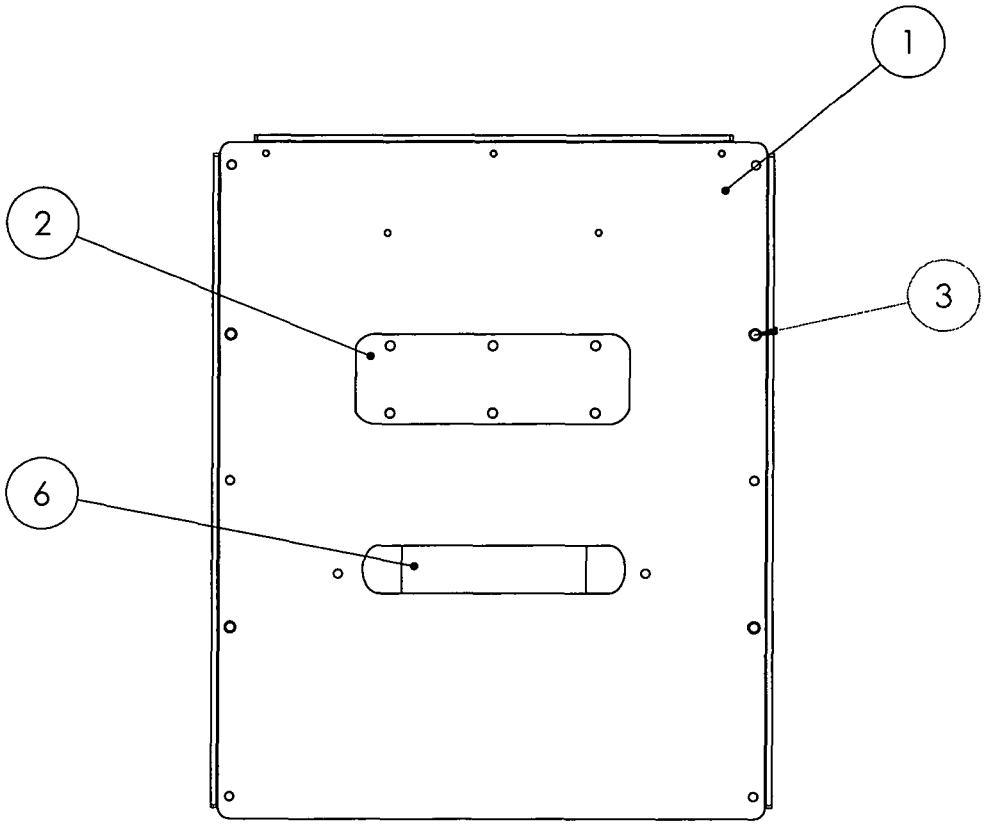
FIG. 1 is the protected side view of the primary ballistic plate.

As shown in FIG. 1, a basic ballistic shield assembly comprised of a ballistic plate 1 a viewport 2, a feature to connect to another ballistic plate 3 and handle 6. Each ballistic plate in these embodiments shall be made of material sufficient for the threat level designed to encounter. Also because this is primarily designed to be man portable (carried by hand or on rollers), weight of the ballistic materials is a prime consideration. For National Institute of Justice (NIJ) level 3A and NIJ 3, a polymer based material made of aramid, para-aramid or polypropylene is recommended. However for NIJ4 shields which may be supported by wheels, steel laminate plates with high hardness and ceramic plates are recommended.

Figure 2:
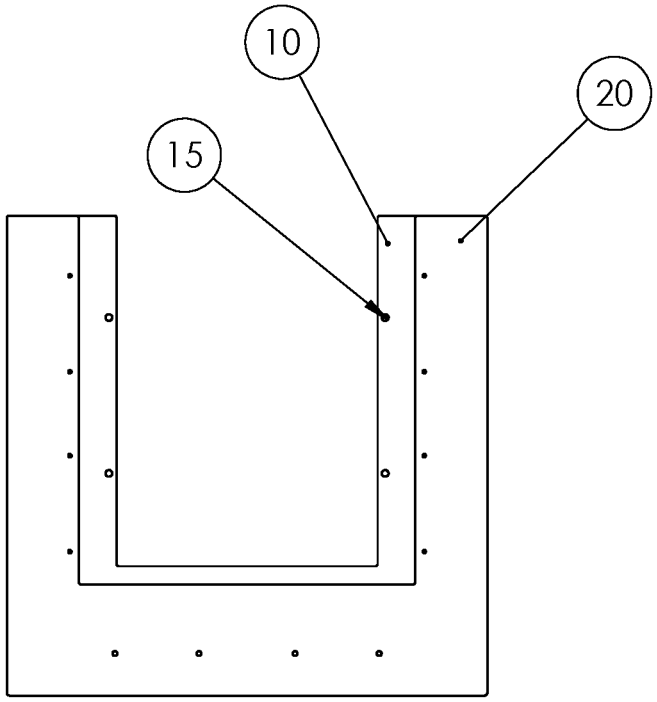
FIG. 2 is the front view of a secondary ballistic plate.

FIG. 2 shows the secondary ballistic plate 10 with an additional ballistic plate 20 attached to it. An additional ballistic plate may be attached to the secondary plate for many reasons, such as to use a lighter ballistic material than the secondary plate. The secondary plate has a component or feature 15 to connect the secondary plate to the primary plate. In FIG. 2 the secondary plate only has holes for which bolts can be mounted to fasten the primary plate 1 to the secondary ballistic plate 10. It must be noted that any way to attach the plates such as a quick disconnect track would be acceptable.

Figure 3:
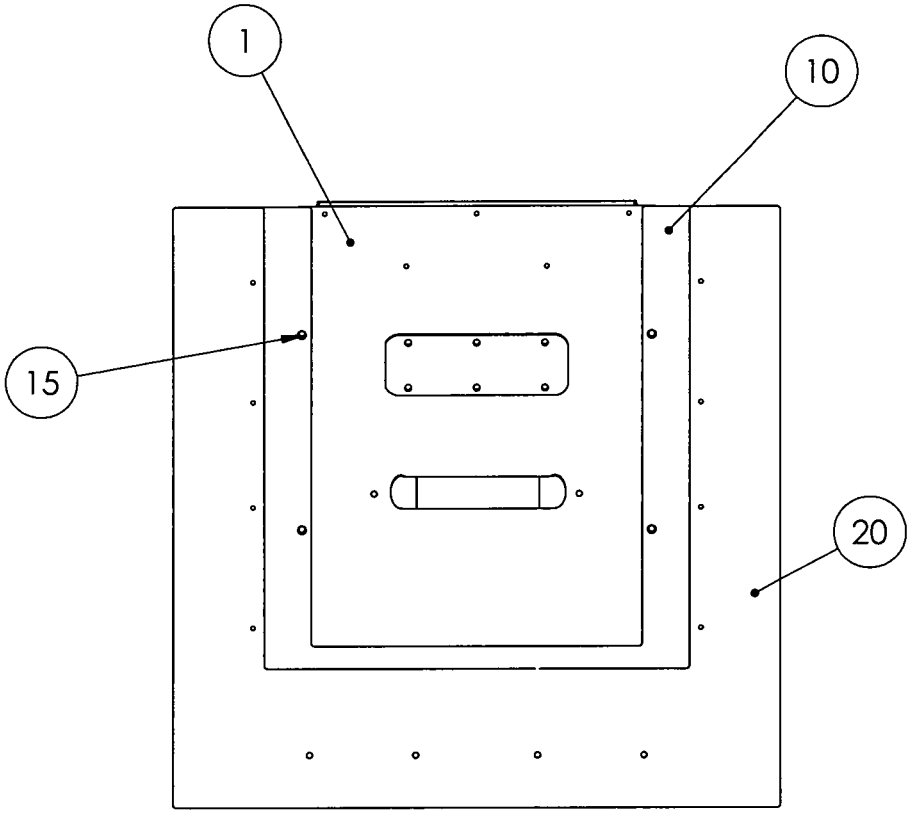
FIG. 3 is the protected side view of the primary ballistic plate connected to a secondary ballistic plate.

FIG. 3 shows the protected (user) side view of the primary ballistic plate 1 attached to the secondary ballistic plate 10. FIG. 3 shows that the primary ballistic plate 1 is connected on center to the secondary ballistic plate 10 such that approximately equal masses of ballistic material lay to the sides of the primary ballistic plate 1. This enables the user easier one handed holding of the handle 6. In addition, the user can use the handle 6 and the viewport 2 for the entire assembly.

Figure 4:
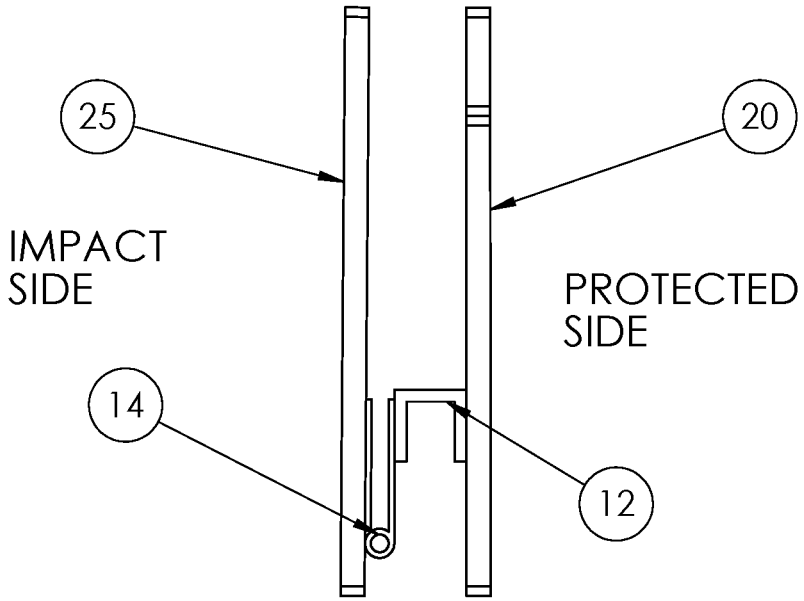
FIG. 4 is a side view of a folding side ballistic assembly.

FIG. 4 shows a spacer 12 attached to ballistic plate 20 and a hinge 14 attached to both the spacer 12 and a rotating ballistic plate 25. In FIG. 4 the leafs of the hinge are oriented such that the rotating ballistic plate covers the ballistic plate 20 along with the adjoining secondary ballistic plate 10.

Figure 5:
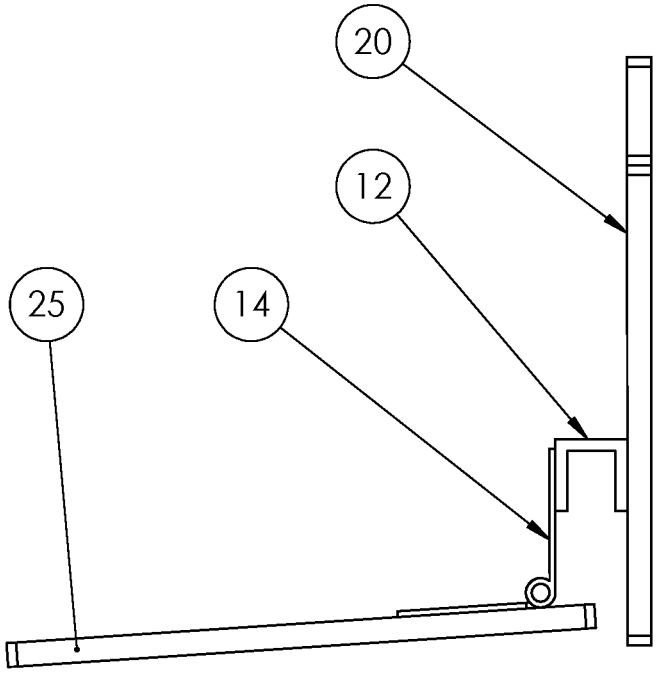
FIG. 5 is the side view of the rotating ballistic plate shown while rotating.

In FIG. 5 the rotating ballistic plate is moving downward. FIG. 5 illustrates that the width of the spacer 12 must be sufficient such that collision does not occur between the rotating ballistic plate 25 and ballistic plate(s) 20 or 10.

Figure 6:
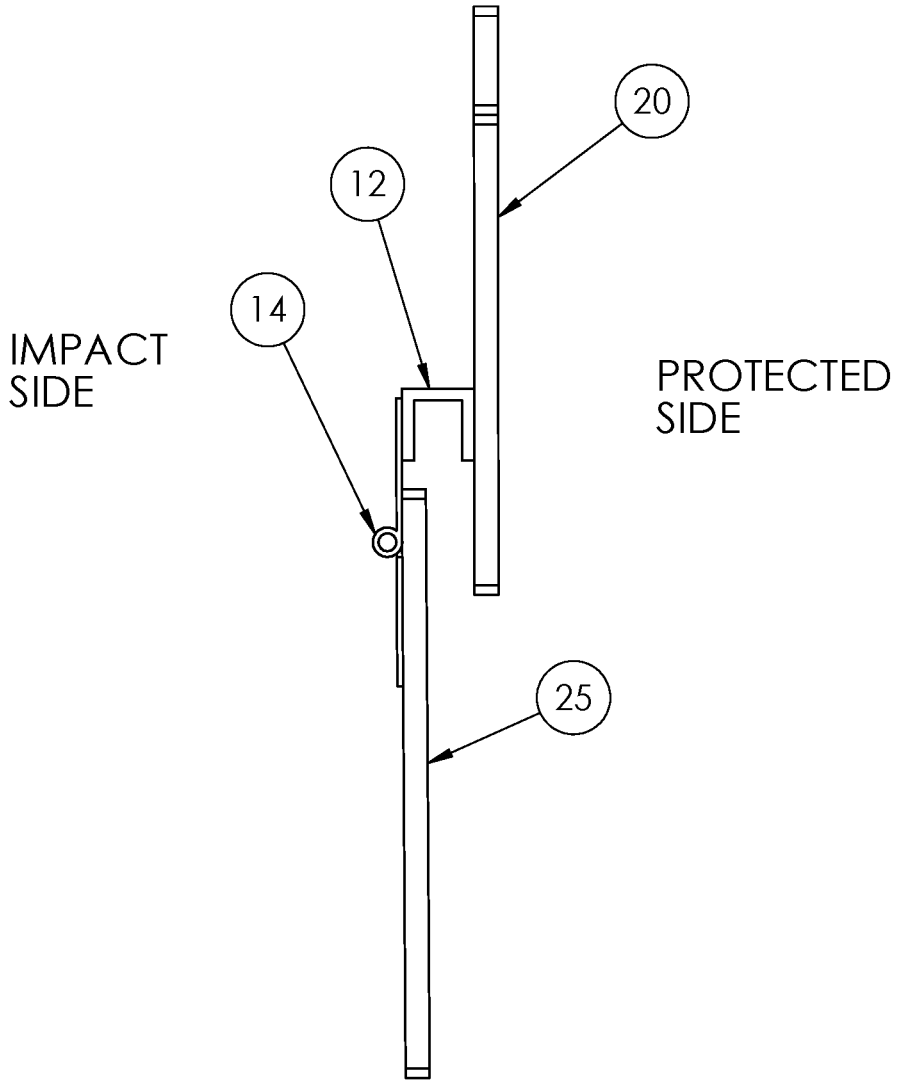
FIG. 6 is the side view of the rotating ballistic plate when completely down.

FIG. 6 shows that when the leafs of the hinge 14 are 180 degrees apart, rotating ballistic plate 25 and ballistic plate 20 (and any ballistic plate attached to ballistic plate 20) which are separated by a spacer 12 and hinge 14, are parallel, but not coplanar. In this orientation maximum ballistic coverage is achieved. It is critical that the rotating ballistic plate 25 extends over the leaf of the hinge which is connected to the spacer. Although not fastened to the leaf connected to the spacer, the extension will provide rigidity with respect to horizontal forces for the ballistic shield when the rotating plate is downward. Also in this configuration there is overlap of ballistic plates 25 and 10 such no gap exists for a horizontal projectile to pass between the plates.

Figure 7:
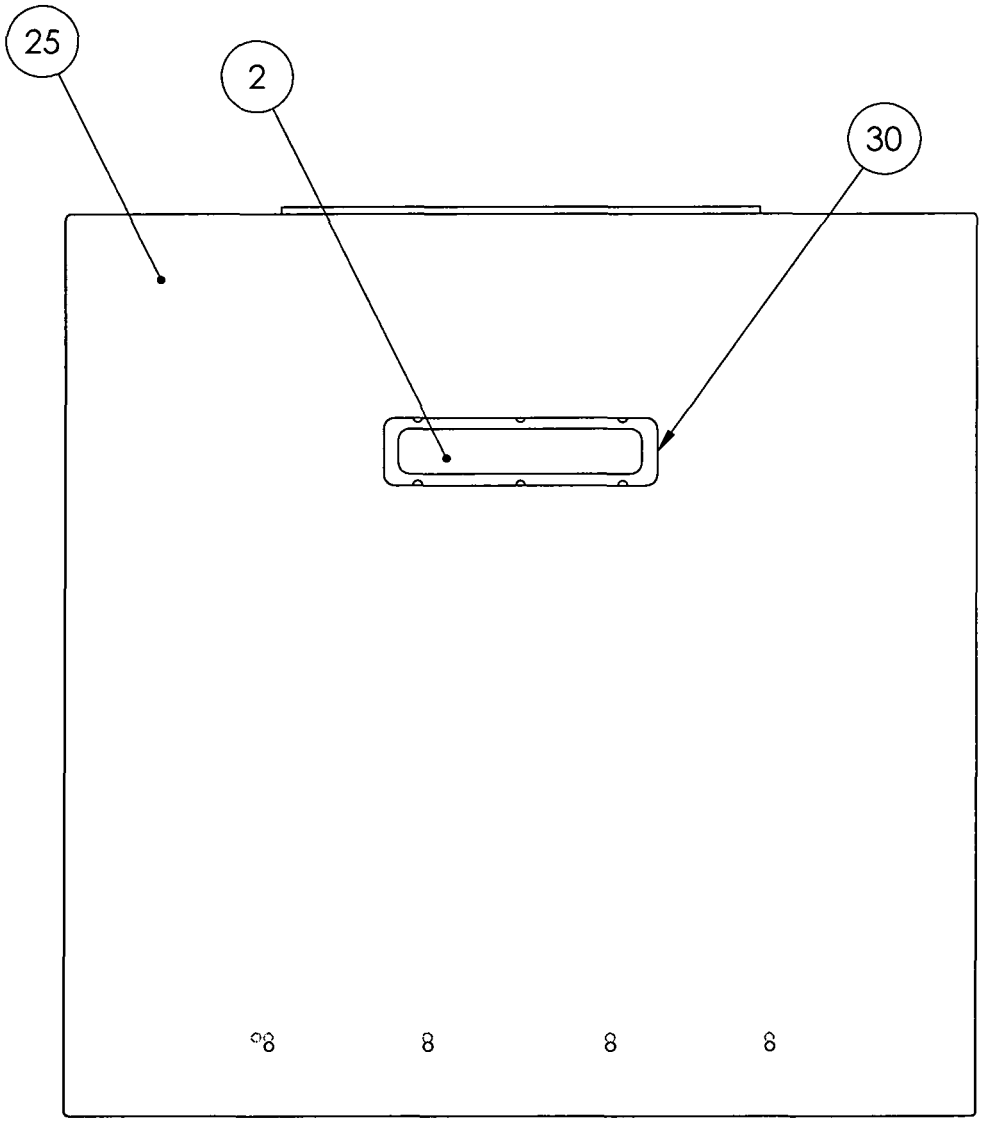
FIG. 7 is the front view of the impact side of the rotating ballistic plate when it is folded up to cover the primary and secondary ballistic plates.

FIG. 7 shows the impact side when the rotating ballistic plate 25 is folded upward to lay parallel with ballistic plates 10 and 20 as in FIG. 4. The viewport 2 is visible through the removal of ballistic material 30 in the rotating plate 25. The viewport 2 is transparent and can be made of NIJ level 3A or 3 or 4 layered polycarbonates or a layered glass, polycarbonate and polyurethane construction. The viewport materials must overlap the rectangular opening in the non-transparent ballistic materials and be bolted to them.

The variable configuration allows the users to increase the resistance of the ballistic protection of just one ballistic plate for higher velocity projectiles. When the rotating ballistic plate 25 is folded upward the maximum ballistic coverage is decreased. The concept of overlapping ballistic plates for increased ballistic protection and the expense of decreased ballistic coverage is called "ballistic layering".

The scope of the invention is defined by the following claims and their physical equivalents.

What is claimed:

1. A ballistic shield selectively deployable in a first configuration or a second configuration comprising a first protective portion including a first protective component and a second component detachably attached to each other and a second protective portion selectively rotatably between a first position and second position hingedly coupled to said second component of said protective portion such that when said ballistic shield is in said first configuration said first protective component is detached from said second component said first protective shields the head and neck of a person holding said ballistic shield in front of the person and when said first protective component and said second component of said first protective portion are assembled to each other and said second protective portion of is in said second position said ballistic shield shields the head, neck and torso of a person holding said ballistic shield in front of the person.

2. The ballistic shield of claim 1 wherein said second component of said first portion and said second portion are in said second configuration, said second component of said first and said second portion are substantially coplanar.

3. The ballistic shield or claim 1 wherein said first protective component and said second component of said first portion are substantially parallel when said ballistic shield is in said second configuration.

* * * * *